US006918751B2

(12) United States Patent
Brandt et al.

(10) Patent No.: US 6,918,751 B2
(45) Date of Patent: Jul. 19, 2005

(54) DEVICE FOR MELT SPINNING AND COOLING A FILAMENT BUNDLE

(75) Inventors: Holger Brandt, Ehndorf (DE); Andreas Cohrt, Schaalby (DE); Herbert Peters, Neumunster (DE); Peter Blunck, Gothendorf (DE)

(73) Assignee: Neumag GmbH & Co. KG, Neumunster (DE)

( * ) Notice: Subject to any disclaimer, the term of this patent is extended or adjusted under 35 U.S.C. 154(b) by 312 days.

(21) Appl. No.: 10/194,652

(22) Filed: Jul. 11, 2002

(65) Prior Publication Data

US 2003/0025239 A1 Feb. 6, 2003

(30) Foreign Application Priority Data

Jul. 12, 2001 (DE) ..... 101 34 003

(51) Int. Cl.[7] ..... D01D 5/08; D01D 5/088

(52) U.S. Cl. ..... 425/72.2; 425/150; 425/171; 425/192 S; 425/382.2; 425/464

(58) Field of Search ..... 425/72.2, 464, 425/90, 94, 104, 192 S, 382.2, 150, 171; 264/211.14

(56) References Cited

U.S. PATENT DOCUMENTS 3,858,386 A * 1/1975 Stofan ..... 428/401
4,756,679 A * 7/1988 Stibal et al. ..... 425/72.2
5,866,055 A * 2/1999 Schwarz et al. ..... 264/103
6,062,838 A * 5/2000 Glawion et al. ..... 425/72.2

FOREIGN PATENT DOCUMENTS

DE 37 08 168 A1 3/1987

* cited by examiner

*Primary Examiner*—Joseph S Del Sole
(74) *Attorney, Agent, or Firm*—Smith Moore LLP

(57) ABSTRACT

The invention relates to a device and method for melt spinning and cooling a filament bundle. To this end, the device comprises a spinning device with an annular spinneret for extruding the filament bundle as well as a cooling unit arranged below the spinning device. The cooling unit comprises a holding device and a coolant dispersing head that is connected to said holding device. In an operating position, said coolant dispersing head is substantially centered relative to the spinneret with contact between the spinning device and the holding device. The coolant dispersing head can be guided into a standby position at a distance from the spinneret. According to the invention, a movable shielding means is arranged laterally of the coolant dispersing head and can be moved between an initial position laterally of the coolant dispersing head and a shielding position directly underneath the spinneret.

12 Claims, 3 Drawing Sheets

DEVICE FOR MELT SPINNING AND COOLING A FILAMENT BUNDLE

BACKGROUND OF THE INVENTION

1. Field of the Invention

Figure 1:
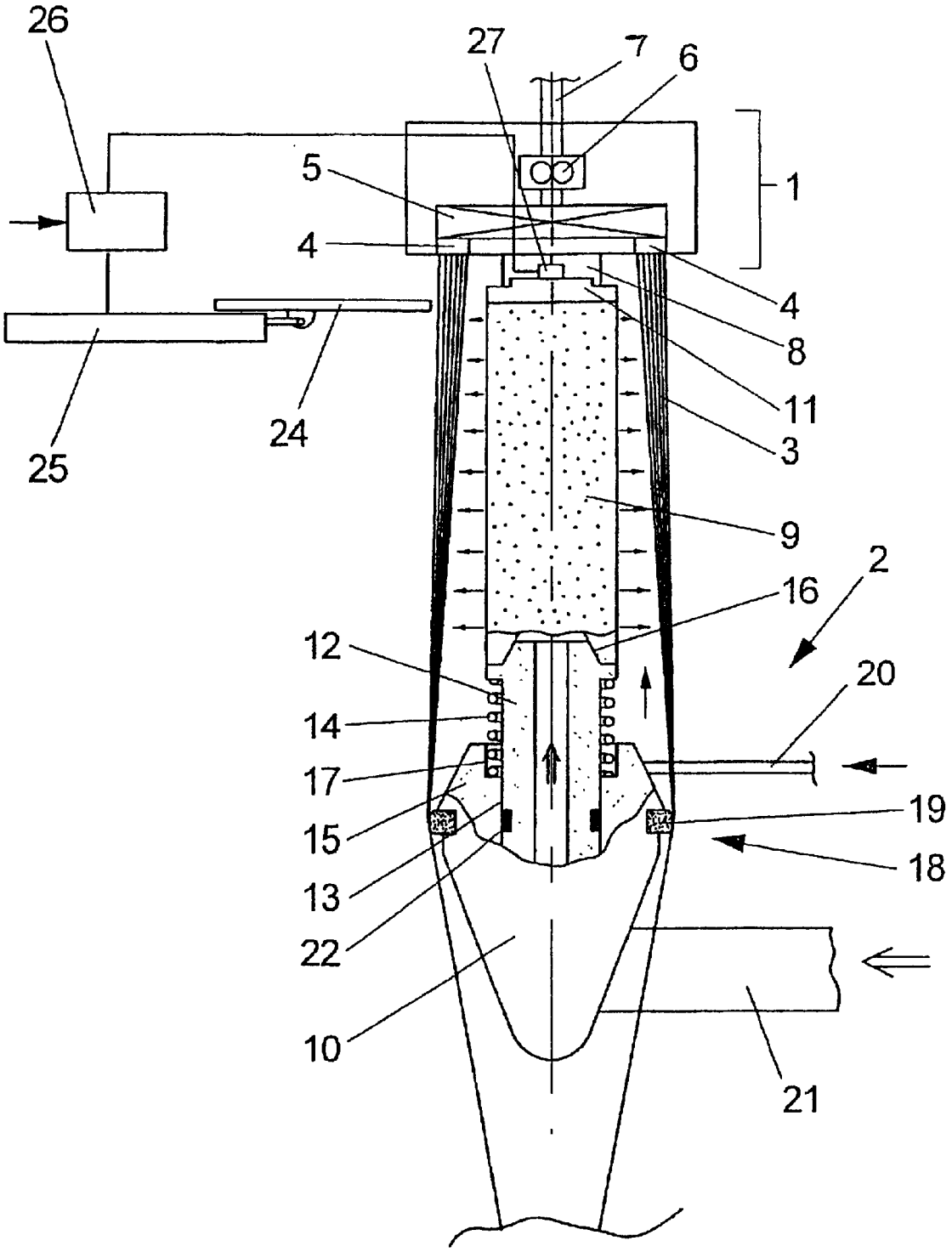

The invention relates to a device for melt spinning and cooling a filament bundle.

2. Description of the Prior Art

When synthetic filaments are melt-spun from a polymer melt using a spinneret with a plurality of passages, a plurality of strand-like filaments extrude from the spinneret. The filament strands coming out of the spinnerets must be cooled before being taken up in the form of threads or thread bundles after further treatment. The cooling medium used is preferably air, which flows perpendicularly to the thread direction and is trained onto the filaments. The cooling air can permeate the filament bundle from the exterior toward the interior or from the interior toward the exterior. The present invention relates to the type of device in which the cooling air stream permeates a filament bundle from the interior toward the exterior as described, for instance, in German Laid-Open Publication DE 37 08 168 A1.

In the known device, the filament bundle is produced by an annular spinneret of a spinning device. A cooling unit is provided below the spinning device and comprises a coolant dispersing head that is substantially centered relative to the spinneret. This coolant dispersing head is connected to a holding device through which a cooling medium is introduced into the interior of the coolant dispersing head. The coolant dispersing head has a porous shell that is made, for instance, of a sintered material, such that the cooling air flowing into the interior of the coolant dispersing head exits radially therefrom and permeates the filament bundle. In this type of device, the coolant dispersing head can be displaced between an operating position and a standby position to permit startup of spinning the filament bundle at the beginning of the process. In the operating position, the coolant dispersing head is held in contact with the spinning device directly underneath the spinneret. In the standby position, the coolant dispersing head is held at a distance from the spinneret, so that melt particles falling off the spinneret do not impair the coolant dispersing head. In the prior-art device, the coolant dispersing head is guided completely out of the spinning area when in the standby position for this purpose, thereby causing especially prolonged downtimes if the process is interrupted.

Accordingly, there is a need in the art for a device of the initially described type wherein the spinneret can be rapidly and safely separated from the coolant dispersing head if the process is interrupted.

BRIEF SUMMARY OF THE PRESENT INVENTION

The present invention fulfills this need by providing a spinneret that is distinguished in that the spinneret is shielded from the coolant dispersing head during a process interruption, such that melt particles and filament residues falling from the spinneret can be safely collected. The standby position of the coolant dispersing head can advantageously be formed by a position within the spinning line, such that the operating position or the standby position of the coolant dispersing head can be adjusted solely by adjusting the height of the coolant dispersing head. In the standby position a space is formed between the spinneret and the coolant dispersing head, such that a shielding means can be guided between the spinneret and the coolant dispersing head. To this end, the shielding means is arranged laterally of the coolant dispersing head and can be guided from an initial position to a shielding position between the spinneret and the coolant dispersing head.

In a particularly advantageous further development of the invention, guidance of the coolant dispersing head into the standby position and the movement of the shielding means into the shielding position are linked. This significantly shortens the downtime if production is interrupted. Linking the guidance of the coolant dispersing head and the movement of the shielding means is advantageously achieved by a control device that controls an actuator for moving the shielding means.

In a preferred further development of the invention, the control device is connected to a sensor, which monitors the position of the coolant dispersing head. The sensor can, for instance, be embodied as a touch sensitive switch, which senses contact with the coolant dispersing head below the spinning device. As soon as the coolant dispersing head disengages from the spinning device, the sensor sends a corresponding signal to the control device.

However, the control device can also be directly connected to an additional actuator, which is provided for changing the position of the coolant dispersing head. Thus a signal produced by the positional change of the coolant dispersing head can be used directly to move the shielding means.

A particularly advantageous further development of the invention provides that the control device be connected to a thread breakage sensor. Thus, immediately after a broken thread is detected, the coolant dispersing head can be separated from the spinneret in the spinning line. The signals of the thread breakage sensor are converted within the control device to activate the actuators.

In principle, the coolant dispersing head can be guided from its operating position into its standby position in two different manners. In a first variant, the coolant dispersing head and the holding device are firmly connected to one another, so that the coolant dispersing head and the holding device are axially displaced together.

In a particularly advantageous further development of the invention, the coolant dispersing head can be axially displaced relative to the holding device between the operating position and the standby position. This axial movability of the coolant dispersing head has the particular advantage that the coolant dispersing head can be held in its operating position or standby position independent of the relative position between the holding device and the spinning device.

To replace the coolant dispersing head from the cooling unit, which is positioned directly below the spinning device, the coolant dispersing head, according to another advantageous further development of the invention, is detachably connected to the holding device. Thus, in the standby position, the coolant dispersing head is removed from the holding device and after cleaning or replacement is remounted on the holding device. The holding device with the supply lines for the cooling medium can advantageously be kept stationary.

In a particularly advantageous further embodiment of the invention, the coolant dispersing head is held in its operating position by the actuator, which is provided between the coolant dispersing head and the holding device. This ensures that the coolant dispersing head is securely guided and held in its operating position after each replacement.

The actuator can be formed by electric, pneumatic or hydraulic means.

The holding device of the cooling unit is preferably used to receive a finishing device that is mounted to the holding device below the coolant dispersing head. Said finishing device is provided with a finishing ring which is contacted by the filament bundle and which applies a finishing agent to the filaments.

To obtain uniform wetting and distribution of the finishing agent along the surface of the finishing ring on the one hand and to ensure low-wear and secure thread guidance on the other hand, the finishing ring is preferably formed by several ceramic disks.

The further development of the invention that the holding device is designed to be pivotable relative to the spinning device is particularly advantageous for guiding the cooling unit completely out of the spinning line.

DETAILED DESCRIPTION OF THE PREFERRED EMBODIMENTS

Figure 2:
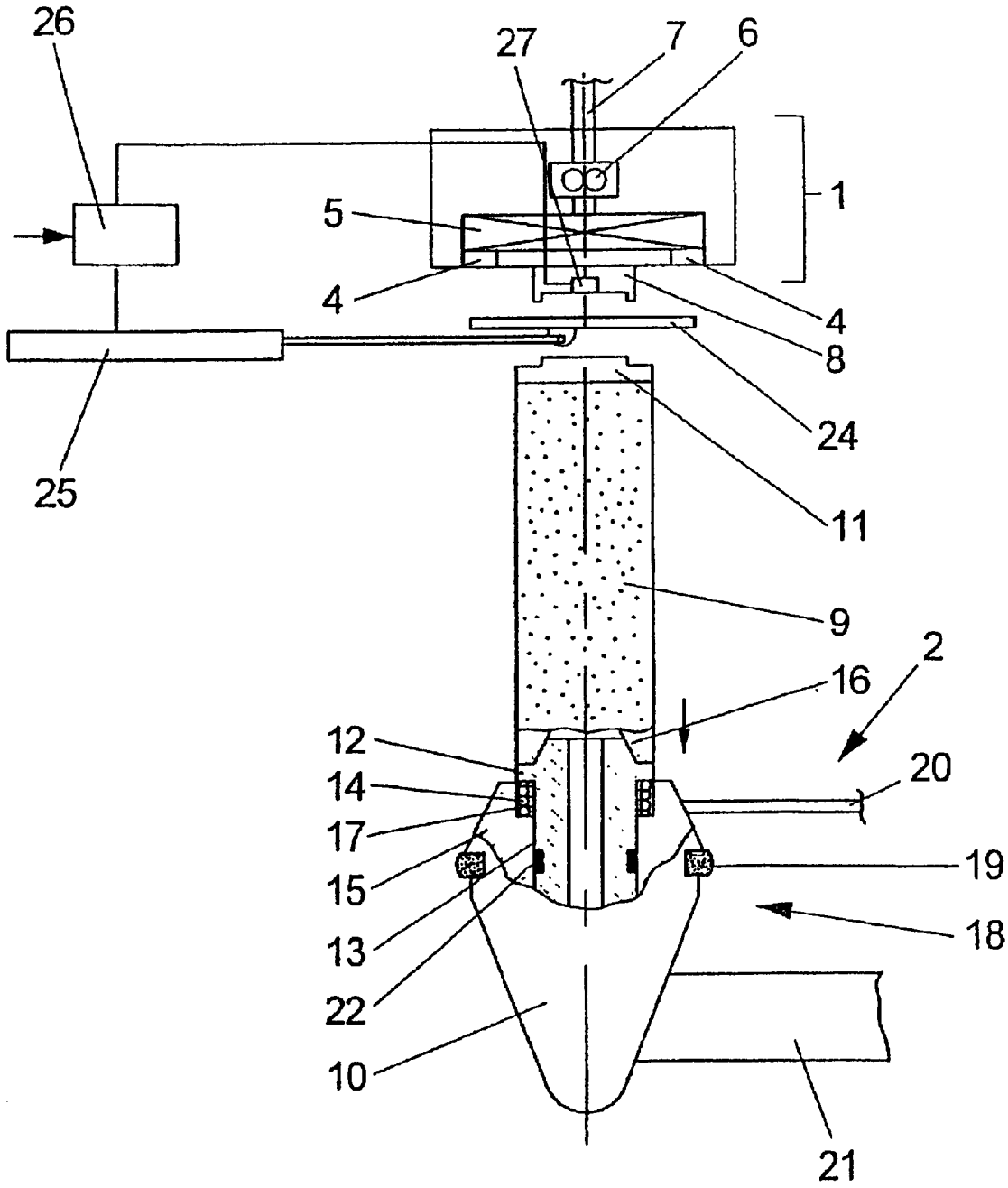
Figure 3:
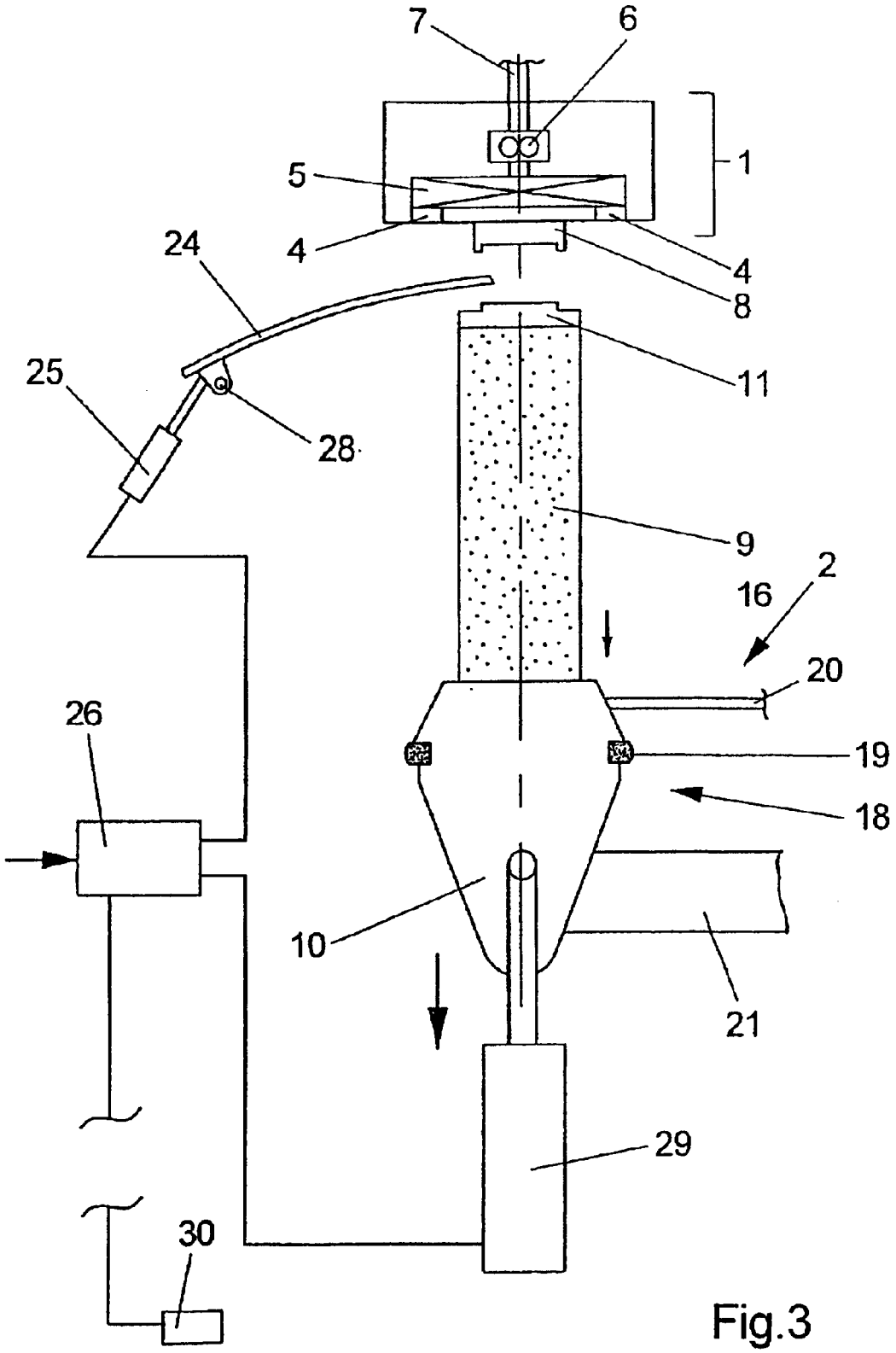

Some embodiments of the device according to the invention will now be described in greater detail, by way of example, with reference to the attached drawings in which FIGS. 1 and 2 schematically show a first exemplary embodiment of the device in operation according to the invention, and FIG. 3 schematically shows an additional exemplary embodiment of the device in operation according to the invention.

FIGS. 1 and 2 schematically show a first exemplary embodiment of the device according to the invention. FIG. 1 shows the device in operation and FIG. 2 out of operation. Unless express reference to one of the figures is made, the following description applies to both.

The device comprises a spinning device 1 and a cooling unit 2 arranged below said spinning device 1. On its lower side, the spinning device 1 is provided with an annular spinneret 4, which is connected to a spinning pump 6 via a melt distributor 5. Said spinning pump 6 via a melt line 7 is connected to a melt generator (not depicted).

The cooling unit 2 below the spinning device 1 comprises a holding device 10 and a coolant dispersing head 9 connected to said holding device 10. The coolant dispersing head 9 has a porous shell that can be made, for instance, of a nonwoven material, wire gauze, or a sintered material. At its free end, the coolant dispersing head 9 is sealed by a centering shoulder 11.

At the end of the coolant dispersing head 9 facing toward holding device 10, the coolant dispersing head 9 is provided with a connecting piece 12. Said connecting piece 12 and the coolant dispersing head 9 are interconnected via a conical seat 16. Connecting piece 12 is tubular and forms an axial extension of the coolant dispersing head 9. With its free end, connecting piece 12 is inserted into a holding fixture 15 of the holding device 10. The cylindrical connecting piece 12 is slidingly guided within a center opening 13 of holding fixture 15. In the guide section of connecting piece 12, a seal 22 is provided along the circumference. Connecting piece 12 is shaped as a hollow cylinder and is connected to a pressure chamber within holding device 10. This pressure chamber within holding device 10 is connected to a pressure source via an inlet 21.

At the end of holding fixture 15 facing toward the coolant dispersing head, an annular space 17 is formed between holding fixture 15 and connecting piece 12 in which a spring 14 is arranged. Spring 14 is tensioned between a collar 29 of connecting piece 12 and a stage of holding fixture 15.

Along the circumference of holding device 10, a finishing device 18 is provided, which comprises a finishing ring 19 that is inserted in holding device 10. Finishing ring 19 is supplied from the interior with a liquid finishing agent that is supplied via a line 20.

A shielding means 24 is provided laterally of coolant dispersing head 9 and spinneret 4. Said shielding means 24, which can be made, for instance, from sheet metal, is movable in horizontal direction and for this purpose is guided by an actuator 25. Actuator 25 is controlled via control device 26. Control device 26 is coupled with a sensor 27, which is arranged on end stop 8 along the lower side of spinneret 4. Sensor 27 is configured as a contact sensor, which is actuated by the centering shoulder 11 of coolant dispersing head 9.

FIG. 1 depicts the device in operation. Here, the coolant dispersing head 9 is held in an operating position by springs 14 and connecting piece 12. The centering shoulder 11 of the coolant dispersing head 9 rests against end stop 8 of the spinning device 1. End stop 8 is arranged on the underside of spinning device 1 and is substantially centered relative to spinneret 4.

The centering shoulder 11 of coolant dispersing head 9 resting against end stop 8 activates sensor 27. Sensor 27 signals the operating position of coolant dispersing head 9 to control device 26. Actuator 25 for moving shielding means 24 remains disabled. Shielding means 24 is in its initial position, laterally of coolant dispersing head 9.

In the operating position, a cooling medium, preferably a cooling air stream is supplied via inlet 21 and a pressure chamber formed within the holding device. Via the pressure chamber, the cooling medium is guided through the hollow cylindrical connecting piece 12 into the interior of the coolant dispersing head 9. The cooling medium now uniformly penetrates the shell of the coolant dispersing head 9 in outward direction, flowing from the interior to the exterior through a filament bundle 3 that is produced by spinneret 4. After the filaments of filament bundle 3 have been cooled, they are conditioned in a finishing device 18. For this purpose, a finishing agent is guided via line 20 to the finishing ring 19. Finishing ring 19 can, for instance, be made of a porous material, such that the finishing agent is uniformly distributed in finishing ring 19 and exits along the surface to condition the filaments. After finishing, the filament bundle is ready for further processing. The filament bundle can, for instance, be guided to form threads, which are wound up, or it can be combined into a sheaf of threads and deposited as a can.

FIG. 2 shows the device according to the invention out of operation. Coolant dispersing head 9 of cooling unit 2 is in its standby position. Here, coolant dispersing head 9 with connecting piece 12 is axially displaced in thread direction against spring 14. This can be accomplished, for instance, by an actuator (not depicted). The centering shoulder 11 of the coolant dispersing head 9 is thereby disengaged from limit stop 8 of spinning device 1.

Sensor 27 detects this separation between limit stop 8 and centering shoulder 11 of coolant dispersing head 9. Subsequently, actuator 25 is activated via control device 26. The shielding means 24 is then guided from its initial position into a shielding position between spinneret 4 and coolant dispersing head 9. Shielding means 24 shields coolant dispersing head 9 against spinneret 4. This prevents impairment of coolant dispersing head 9 by, for instance, cleaning work on the spinneret 4. Only after any process interruption has been eliminated, the process is resumed through spinning startup. For this purpose, control device 26 receives an external instruction to activate actuator 25 such that shielding means 24 is returned from its shielding position to its initial position. After shielding means 24 has reached its initial position, coolant dispersing head 9 is returned from its standby position to its operating position.

In standby position, connecting piece 12 is locked into holding fixture 15 by auxiliary means (not depicted), such that spring 14 cannot unintentionally displace coolant dispersing head 9 in the direction of the spinning device. In standby position, coolant dispersing head 9 can be easily detached from its conical seat 16, for instance to replace it with a new coolant dispersing head. This exchange can advantageously be performed only by an operator to minimize production interruption due to coolant dispersing head replacement. At the same time, while coolant dispersing head 9 is removed, the underside of spinneret 4 can be cleaned. Holding device 10 of cooling unit 2 can be held stationary during this procedure. It is also possible, however, to make holding device 10 height adjustable or pivotable relative to spinneret 1. Height adjustment of holding device 10 is particularly advantageous for adjusting the finishing position during operation of the device.

In the exemplary embodiments depicted in FIGS. 1 and 2, it is also possible to arrange sensor 27 in a position between holding device 10 and coolant dispersing head 9. Sensor 27 can be used to cause shielding means 24 to be extended and retracted. The sensor can also be formed by electrical or optical means, which do not require direct contact with one of the parts of the device.

FIG. 3 shows a further exemplary embodiment of a device according to the invention. This embodiment according to FIG. 3 is substantially identical to the preceding embodiment. Only the essential differences will be described below. Components with like functions are provided with identical reference numerals.

The exemplary embodiment depicted in FIG. 3 is shown while out of operation. Coolant dispersing head 9 is depicted just before reaching its standby position and shielding means 24 just before reaching its shielding position.

Coolant dispersing head 9 is firmly coupled to holding device 10. An additional actuator 29 engages with holding device 10 and axially displaces coolant dispersing head 9 and holding device 10 between an operating position (not depicted) and a standby position. The additional actuator 29 is coupled with control device 26. Shielding means 24 is arranged laterally of the free end of coolant dispersing head 9. Shielding means 24 is pivotably supported on a swivel pin 28. Shielding means 24 is coupled with actuator 25, which is configured as a rotary actuator. Actuator 25 is also connected to control device 26.

In the spinning line, in thread direction, behind holding device 10, a thread breakage sensor 30 is positioned in a suitable location. Said thread breakage sensor 30 is coupled with control device 26.

In the embodiment depicted in FIG. 3, the treatment of the filament bundle after melt spinning is monitored during operation. A thread breakage sensor 30, which detects and signals a broken thread, is used for this purpose. Said thread breakage sensor 30 is coupled with control device 26, such that after a thread breakage, actuator 29 is activated to displace coolant dispersing head 9, and actuator 25 to displace shielding means 24. Guidance of coolant dispersing head 9 into a lower standby position is linked to the movement of shielding device 24 into its shielding position, such that directly after separation of centering shoulder 11 from end stop 8, spinneret 4 is shielded by shielding means 24.

The embodiments of the inventive device shown in FIGS. 1–3 are depicted by way of example with respect to the design and execution of their components. Thus, it is also possible, for instance, to combine the embodiment according to FIGS. 1 and 2 with a control of the shielding means depicted in FIG. 3.

What is claimed is:

1. A device for melt spinning and cooling a filament bundle comprising:

a spinning device comprising an annular spinneret for extruding the filament bundle; and a cooling unit arranged below the spinning device comprising:

a holding device; and a coolant dispersing head that is connected to the holding device;

wherein the coolant dispersing head in an operating position is substantially centered relative to the annular spinneret and contacts the spinning device; and wherein the coolant dispersing head can be guided to a standby position at a distance to the spinneret so that a shield that is arranged laterally of the coolant dispersing head can be moved from an initial position laterally of the coolant dispersing head to a shielding position directly below the spinneret.

2. The device as claimed in claim 1, further comprising a first actuator for moving the shield, wherein the first actuator is connected to a control device that controls the first actuator as a function of the positional change of the coolant dispersing head.

3. The device as claimed in claim 2, wherein the control device is connected to a sensor that monitors the position of the coolant dispersing head.

4. The device as claimed in claim 2, further comprising a second actuator for moving the position of the coolant dispersing head, wherein the second actuator is connected to the control device.

5. The device as claimed in claim 4, wherein the control device is connected to a thread breakage sensor.

6. The device as claimed in claim 1, wherein the coolant dispersing head and the holding device can be axially displaced together between the operation position and the standby position.

7. The device as claimed in claim 1, wherein the coolant dispersing head can be axially displaced relative to the holding device between the operating position and the standby position.

8. The device as claimed in claim 7, wherein the coolant dispersing head and the holding device are detachably interconnected such that the coolant dispersing head can be replaced while in the standby position.

9. The device as claimed in claim 1, further comprising a spring located between the coolant dispersing head and the holding device, wherein the spring clamps the coolant dispersing head in the operating position between the holding device and the spinning device.

10. The device as claimed in claim 1, wherein the holding device below the coolant dispersing head carries a finishing device, which is provided with a finishing ring that is contacted by the filament bundle.

11. The device as claimed in claim 10, wherein the finishing ring is formed from a plurality of ceramic disks.

12. The device as claimed in claim 1, wherein the holding device is designed to be pivotable relative to the spinning device.

* * * * *